United States Patent [19]

Keiter et al.

[11] 4,440,514

[45] Apr. 3, 1984

[54] ADJUSTABLE RIBBON FEED RATES DEPENDENT UPON RIBBON TYPE FOR INK RIBBON CASSETTES

[75] Inventors: Alfred Keiter; Wolfgang Mudder; Bernd Tappehorn, all of Wilhelmshaven, Fed. Rep. of Germany

[73] Assignee: Olympia Werke AG, Wilhelmshaven, Fed. Rep. of Germany

[21] Appl. No.: 230,504

[22] Filed: Feb. 2, 1981

[30] Foreign Application Priority Data

Feb. 2, 1980 [DE] Fed. Rep. of Germany ..... 3003886

[51] Int. Cl.[3] ..... B41J 32/00

[52] U.S. Cl. ..... 400/208; 400/227.2; 400/229; 400/232; 400/697.1

[58] Field of Search ..... 400/194, 195, 196, 196.1, 400/207, 208, 208.1, 229, 227.2, 232, 697.1, 144.2

[56] References Cited

U.S. PATENT DOCUMENTS

| | | | |
|---|---|---|---|
| 3,346,090 | 10/1967 | Goff, Jr. et al. | 400/208 |
| 3,604,549 | 9/1971 | Caudill et al. | 400/208 |
| 3,643,779 | 2/1972 | Anderson et al. | 400/196 |
| 3,834,511 | 9/1974 | Hengelhaupt | 400/232 X |
| 3,899,065 | 8/1975 | Brignole | 400/232 X |
| 3,923,141 | 12/1975 | Hengelhaupt | 400/232 X |
| 4,010,839 | 3/1977 | Guerrini et al. | 400/208 |
| 4,231,667 | 11/1980 | Behrendt et al. | 400/229 X |
| 4,235,664 | 11/1980 | Menke | 400/144.2 X |

FOREIGN PATENT DOCUMENTS

| | | | |
|---|---|---|---|
| 33532 | 8/1981 | European Pat. Off. | 400/208 |
| 2642069 | 3/1978 | Fed. Rep. of Germany | 400/232 |
| 2904488 | 8/1980 | Fed. Rep. of Germany | 400/208 |
| 2904489 | 8/1980 | Fed. Rep. of Germany | 400/208 |
| 2065563 | 7/1981 | United Kingdom | 400/232 |

*Primary Examiner*—Ernest T. Wright, Jr.
*Attorney, Agent, or Firm*—Spencer & Frank

[57] ABSTRACT

A feed mechanism for advancing an ink ribbon, supported in a cartridge which is inserted into a typing machine, in feeding steps whose length is determined in dependence upon the type of the ribbon, the mechanism including: a feed roller rotatably mounted in the cartridge for engaging the ribbon to advance it in feeding steps, the roller being selected from a plurality of rollers having respectively different diameters on the basis of the type of the ribbon; a driving device mounted in the machine and including a pressure roller movable into a position against the feed roller when the cartridge is inserted in the machine; and a mechanism for rotating the feed roller in angular steps for advancing the ribbon in corresponding feeding steps, which mechanism is settable for causing each angular step of rotation of the feed roller to have a selected one of at least two different magnitudes, each magnitude corresponding to a respectively different ribbon feeding step length, and is coupled to the pressure roller in a manner to be set to produce angular rotation steps of a selected magnitude in dependence on the position of the pressure roller when it is in its position against the feed roller, whereby the magnitude of each ribbon feeding step is automatically determined as a function of the diameter of the selected feed roller.

14 Claims, 8 Drawing Figures

ADJUSTABLE RIBBON FEED RATES DEPENDENT UPON RIBBON TYPE FOR INK RIBBON CASSETTES

BACKGROUND OF THE INVENTION

The present invention relates to a ribbon cassette, or cartridge, of the type which can be inserted into a typewriter or similar office machine and which includes a ribbon which is brought from a supply reel and past guides through a printing station in the machine, and which is then wound onto a takeup reel.

In typewriters or similar office machines employing ribbon cassettes, use is generally made either of textile ribbons which are transported from one reel to the other or in the form of an endless loop several times past the printing station, or of single-use carbon ribbons which pass through the machine only one since each surface portion of such a ribbon can be used for printing only once, or of multi-use carbon ribbons which also pass through the machine only a single time but in which individual surface sections furnish multiple imprints. In the case of textile ribbons, the magnitude, or length, of each step is not so important since each surface section of the ribbon is used several times. In the case of single-use carbon ribbons, the advancing step must equal the width of a whole character, while the multi-use carbon ribbons require a drive for the ribbon which produces a smaller advancing step so as to provide economical utilization of the ribbon.

To switch a ribbon drive automatically, to the respective mode of operation required, simply by inserting the particular ribbon cassette, the cassette used in a prior art drive disclosed in German Auslegeschrift [Published Patent Application] No. 1,611,454 has a feature which changes the length of the transporting step in dependence on the type of ribbon disposed therein. A transporting roller disposed at the side of the machine is here connected with a translatory gear mechanism which is positively switched by the cassette for changing the length of the transporting step in the cassette so that a longitudinal transporting step is produced which in one case corresponds to the width of type which has been struck and in the other case causes the type imprints on the ribbon to overlap.

Furthermore, U.S. Pat. No. 4,231,667 discloses a drive for a ribbon disposed in a cassette wherein the ribbon is advanced by driving a feed roller. This feed roller is coupled with a device in the machine side for generating a ribbon advancing step of a length which differs in dependence on the type of ribbon employed. On the driven side, this device has two gear members which rotate at respectively different peripheral speeds and only one of which can be coupled with the feed roller disposed in the cassette when this cassette is placed onto the machine. Coupling of a toothed wheel which is firmly connected with the cassette with another toothed wheel associated with the machine is not always possible without malfunction since the parts to be coupled will not always be in a precise position with respect to one another.

Although a removable cassette for a carbon ribbon for typewriters and other office machines disclosed in German Offenlegungsschrift [Laid-Open Patent Application] No. 2,553,329 has a toothed wheel which cooperates with the outermost turn of a winding reel and which is driven by a drive element in the machine, this prior art device permits only a constant length ribbon transporting step and does not provide a way for differently driving the ribbon in dependence on the type of ribbon employed. Also, this prior art arrangement does not provide optimum utilization of the storage area for the supply and takeup reels since the toothed roller and the pivot lever for the takeup reel are also disposed in the storage area.

SUMMARY OF THE INVENTION

It is an object of the present invention to provide a ribbon cassette which is suitable for different types of ribbons and which can easily be placed onto the receiving device of an office writing machine and removed therefrom without requiring special skills on the part of the machine operator.

Another object of the invention is to provide a cassette whose insertion into the receiving device automatically actuates the step length changing device depending on the type of ribbon employed. A further object of this invention is to permit such device to be made of parts which can be easily and inexpensively manufactured and assembled.

The above and other objects are achieved, according to the invention, in a feed mechanism for advancing an ink ribbon supported in a cartridge which is inserted into a typing machine, in feeding steps whose length is determined in dependence upon the type of the ribbon, the cartridge including a supply reel and a takeup reel between which the ribbon is advanced, by providing the mechanism with: a feed roller rotatably mounted in the cartridge for engaging the ribbon to advance it in feeding steps, the roller being selected from a plurality of rollers having respectively different diameters on the basis of the type of ribbon; a driving device mounted in the machine and including a pressure roller movable into a position against the feed roller when the cartridge is inserted in the machine, and means for rotating the feed roller in angular steps for advancing the ribbon in corresponding feeding steps, the means for rotating being settable for causing each angular step of rotation to have a selected one of at least two different magnitudes, each magnitude corresponding to a respectively different ribbon feeding step length, and the means being coupled to the pressure roller in a manner to be set to produce angular rotation steps of a selected magnitude in dependence on the position of the pressure roller when it is against the feed roller, whereby the magnitude of each ribbon feeding step is automatically determined as a function of the diameter of the selected feed roller.

The feed roller disposed in the housing of the ribbon cartridge enables the transporting step to be automatically fixed when a new ribbon cassette is inserted without it being necessary to specially manually actuate the step length switching device. It is also possible to manufacture common cartridge housings for ribbon cartridges accommodating different types of ribbons. This considerably reduces manufacturing and storage expenses.

DESCRIPTION OF THE PREFERRED EMBODIMENTS

Figure 1:
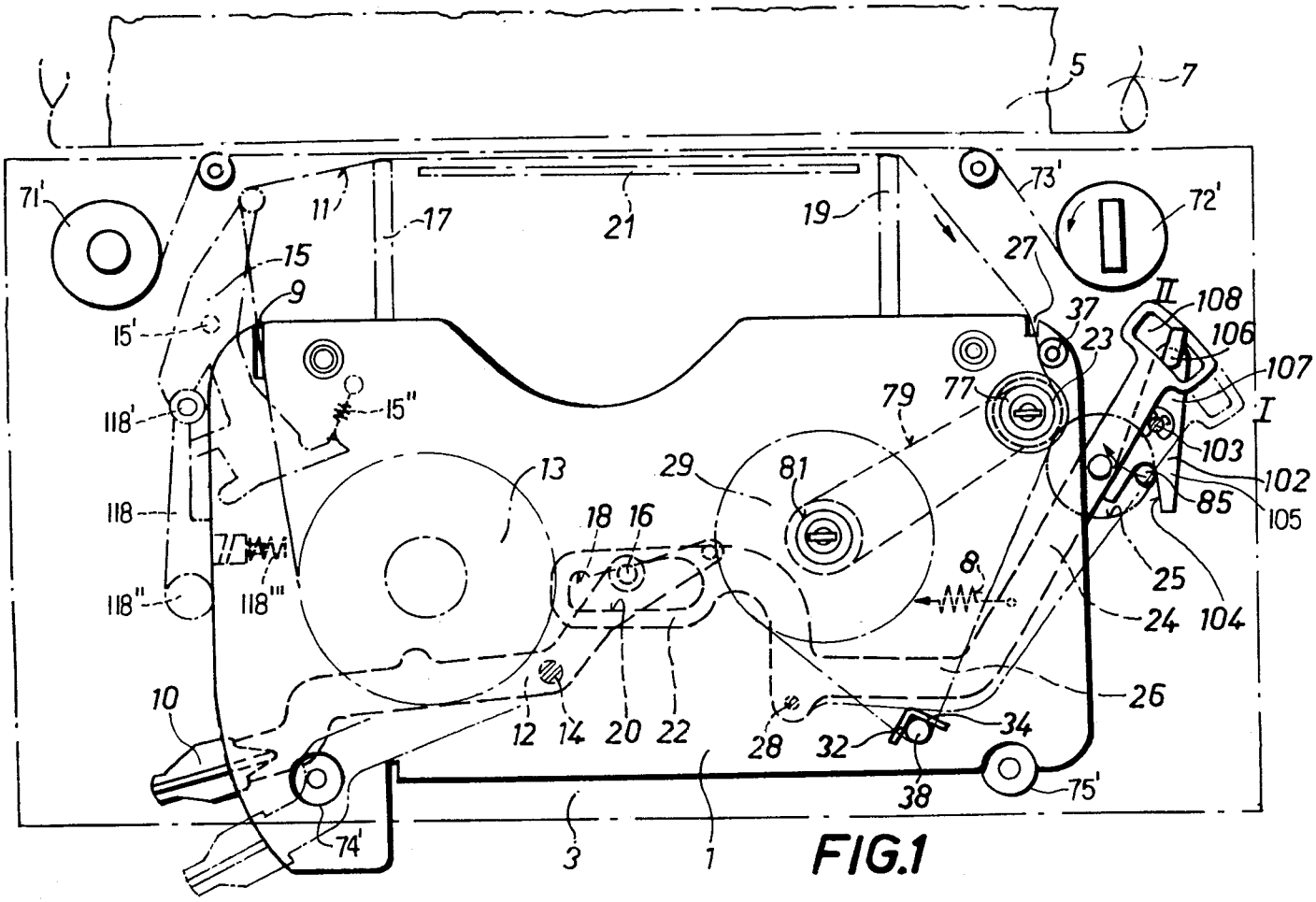
FIG. 1 is a top plan view of a preferred embodiment of a ribbon cartridge according to the invention for a single-use carbon ribbon, with certain hidden parts being shown in broken lines, installed in an office writing machine.

In FIG. 1, a cartridge 1 carrying an inked ribbon 11 is disposed on a receiving device 3 of a typewriter or similar office machine ready for operation, the receiving device 3 being arranged to be movable along a record carrier, such as a sheet of paper, 5. The record carrier 5 is disposed to be transportable in a known manner over a platen 7. The color or carbon ribbon 11 coming out of the exit slit 9 of the ribbon cartridge 1 is unwound from a supply reel 13 and brought past a tensioning lever 15 and over ribbon guide forks 17 and 19 so as to be interposed between the record carrier 5 and a type carrier 21.

The type carrier 21 is, for example, a type wheel having a plurality of radially separated elastic bars whose ends each carry a type character. Such a type carrier is disclosed in U.S. Pat. No. 4,235,664. The type carrier 21 is rotated by means of a motor (not shown) which is also disposed on the receiving device 3. Positioning lever 15 is pivotal about an axis 15' on receiver device 3 and is biassed by a spring 15'' connected to receiver device 3 for maintaining ribbon 11 under the desired tension. Positioning lever 15 is associated with a control lever 118 for moving lever 15 into a retracted position for insertion and removal of cartridge 1. Lever 118 is articulated to lever 15 at a pivot 118' and is pivotal about an axis 118'' on receiver device 3. Lever 118 is biassed into the position shown by a spring 118''' connected to receiver device 3.

Receiver device 3 is further provided with a conventional correction ribbon 73' extending between a supply reel 71' and a takeup reel 72', as well as positioning elements 74' and 75' which engage in recesses provided in cartridge 1 in order to accurately position cartridge 1 on receiver device 3.

Figure 2:
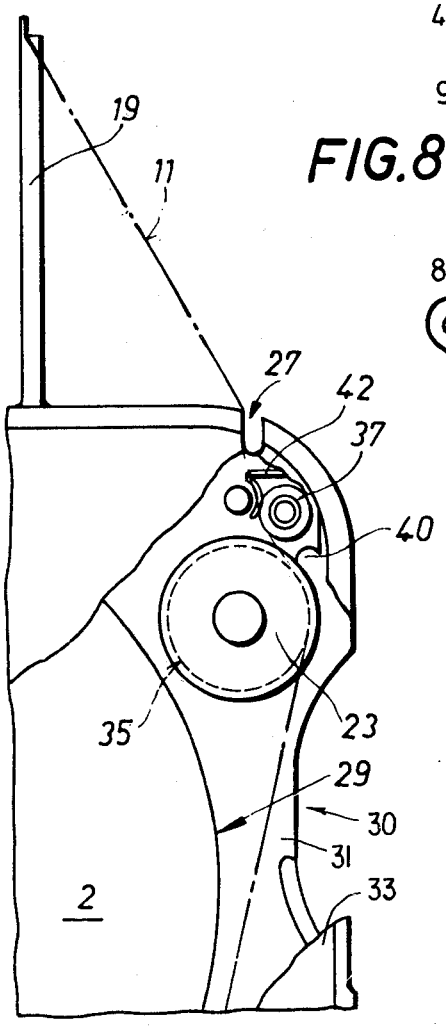
FIG. 2 is a detail plan view of part of the cartridge of FIG. 1 with the cartridge cover broken away.
Figure 8:
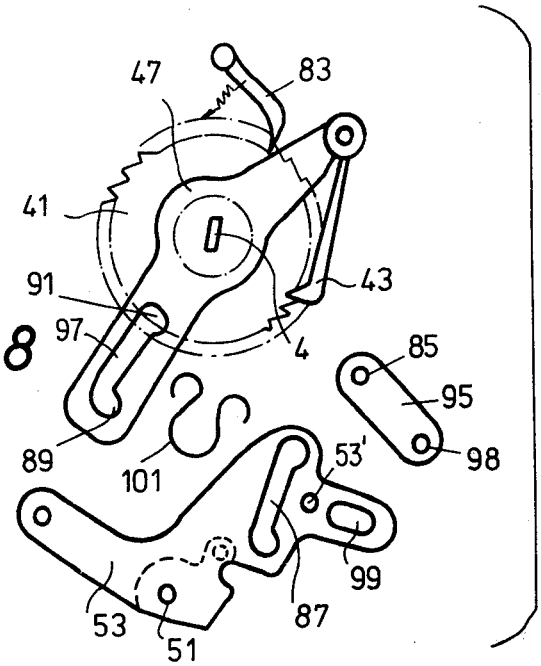
FIG. 8 is an exploded detail plan view of the elements of a drive for the feed roller of FIG. 7.

The ribbon portion which has been used is returned into the cartridge 1 by means of a driven feed roller 23 and a pressure roller 25 which is pressed against the feed roller 23. This ribbon portion is pulled into the cartridge 1 through an entrance slit 27 and is then brought to, and wound around, a takeup reel 29. Pressure roller 25 protrudes into cartridge 1 through an opening 30 in the side wall of cartridge 1, as shown in FIG. 2.

Figure 3:
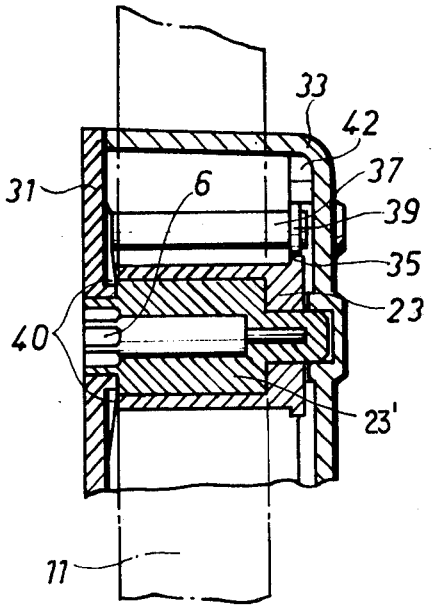
FIG. 3 is a cross-sectional side elevational view of the structure shown in FIG. 2.

As can be seen in FIG. 3, feed roller 23 is mounted on a shaft 23' whose axial ends are rotatably mounted in the bottom plate 31 and the cover 33, respectively, of the cartridge 1. At its end facing the cover 33, the feed roller 23 is provided with a circumferentially continuous flange 35 which prevents contact of the ribbon 11 with the cover 33. In the vicinity of the ribbon entrance slit 27 a deflection roller 37 designed as a deflection guide is rotatably mounted in the cartridge 1, thus increasing the length of the region of contact between ribbon 11 and roller 23. This deflection roller 37 also is provided with a circumferentially continuous projecting flange 39 which assures accurate guidance of the ribbon 11. To assure accurate guidance of the ribbon 11 on the takeup reel 29, the bottom plate 31 is provided with guide faces 40 which rise toward the feed roller 23 and toward the deflection roller 37 in the region of the ribbon entrance slit 27. This assures accurate guiding of the ribbon 11.

By means of a conventional lifting device (not shown), the ribbon 11 is raised, during typing, into the printing position so as to produce an imprint and, after printing,is lowered into a viewing position which exposes the printed line. To achieve this, the ribbon 11 is pivoted in the ribbon entrance slit 27 about a guide rib 42 disposed transversely behind the entrance slit 27 in the cartridge 1, thus preventing excessive soiling of the cartridge 1 and of the machine.

The ribbon 11, which is driven by the feed-roller 23 and the pressure roller 25, is then conducted to the takeup reel 29 via further deflection guide 38 mounted at the side of the takeup reel 29 opposite the entrance slit 27 in the vicinity of the periphery of the takeup reel flange 2 in the cartridge 1. The deflection guide 38, which is firmly connected to the bottom plate 31 of the cartridge 1, assures tight winding of the ribbon 11 on the takeup reel 29. The free end of this deflection guide 38 is supported at cover 33 by guide ribs 32 and 34. THe ribs 32 and 34 and the flange 2 of the takeup reel 29 prevent the ribbon 11, when being deflected around the deflection guide 38, from drifting upwardly and coming into contact with the cover 33. The upper edges of the individual turns of the ribbon coil on reel 29 will therefore form a smooth surface after the takeup process.

The pressure roller 25 is rotatably mounted on a pivot lever 26 which is mounted on the receiving device 3 to be pivotal about an axis 28. This pivot lever 26 has two arms, 22 and 24, the pressure roller 25 being rotatably mounted on the one arm 24 and the other arm 22 being provided with a control cam 20 presenting a detent recess 18 for engaging a detent pin 16. This detent pin 16 is firmly attached to a locking lever 12 which is pivotal about an axis 14 in receiving device 3 and is provided with a manual handle 10. The pivot lever 26 can be reset counterclockwise about axis 28 by the action of an articulated biassing spring 8.

The feed roller 23 and the pressure roller 25 have smooth surfaces and preferably consist of polyurethane elastomers. The surface of the feed roller 23 is made of a polyelastomer, e.g. a product sold under the trade name "Hyrtel", having a Shore hardness A 75–95, to assure accurate transporting of the ribbon 11 over a wide range of temperatures without the ribbon 11 sticking to the feed roller 23.

Figure 7:
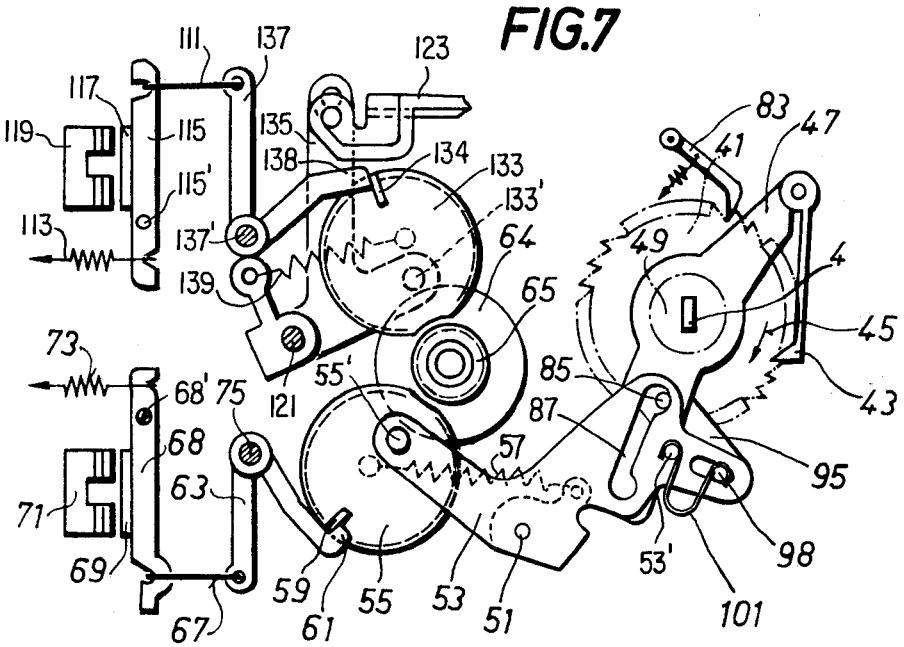
FIG. 7 is a plan view of a device for the feed roller and a step length switching device installed in an office machine to drive the feed roller of a cartridge according to the invention.

The feed roller 23 is provided with a slot 6 accessible from the bottom of the cartridge 1 for engagement by an axially displaceable blade-like drive element 4, shown in FIG. 7. This drive element 4 is interlockingly connected with a drive gear 41 of a ratchet gear unit and is rotatably mounted on the receiving device 3. This drive gear 41 is arranged to be drivable in a clockwise direction 45 via a drive pawl 43. The drive pawl 43 is made in one piece with a plastic pivot lever 47 and lever 47 is mounted on the receiving device 3 to be pivotal about the axis 49 of the drive gear 41, and thus to drive pawl 43.

As shown in FIG. 7, the pivot lever 47 can be coupled in an articulated manner with a drive lever 53 which is pivotal about an axis 51 fixed in receiving device 3, a toothed drive cam 55 being rotatably mounted, via a shaft 55', on the drive lever 53. This drive cam 55 is biassed, or urged, in a counterclockwise direction by a spring 57 articulated to a point spaced from the axis of cam rotation. An abutment 59 mounted on cam 55 is arranged to engage an actuating tongue 61 of an actuating latch 63 so as to maintain cam 55 in an orientation in which it is kept out of engagement with a toothed wheel 65 which is driven by a drive motor 64.

The actuating latch 63 is connected, via a pull rod 67, with a pivot lever 68 which is pivotable about a fixed axis 68' and carries an armature 69 that cooperates with an electromagnet 71. If the electromagnet 71 is excited, the pivot lever 68 is attracted, against the force of a resetting spring 73, thus pivoting the actuating latch 63 clockwise about its pivot axis 75 fixed in the receiving device 3. This brings the actuating tongue 61 out of the effective range of the abutment 59 of the drive cam 55, permitting the cam 55 to be brought, by the action of spring 57, into engagement with the rotating toothed wheel 65. Due to the eccentric design of the drive cam 55, the drive lever 53 is pivoted counterclockwise about its axis 51, causing the pivot lever 47 and, via the drive latch 43, the drive gear 41 to be carried along in a clockwise direction.

Reverting to FIG. 1, rotation of the toothed wheel 41 causes the feed roller 23 also to be rotated clockwise along with a pulley 77 which can be secured to feed roller 23 or engaged by blade-like drive element 4 driven by wheel 41. Pulley 77 is connected in a friction locking manner with a pulley 81, which is fixed to the takeup reel 29 by means of an endless transmission element 79 which can be in the form of a helical spring and which will permit some slippage between pulleys 77 and 81. Rotation of the feed roller 23 and the pressure roller 25 causes the color or carbon ribbon 11 to be advanced from the supply reel 13 and wound onto the takeup reel 29, the latter being rotated via transmission element 79.

When the electromagnet 71 is deactuated, the actuating latch 63 is returned to its starting position shown in FIG. 7, causing the drive cam 55, upon reaching the angular position shown in FIG. 7, to be disengaged from the rotating toothed wheel 65. The drive lever 53 and the pivot lever 47 are likewise returned to their starting positions, reverse rotation of the drive gear 41 in a counterclockwise direction being prevented by a blocking pawl 83. As further shown in FIG. 7, and as disclosed in Federal Republic of Germany Offenlegungsschrift (Laid-open Application) No. 29 04 488, published Aug. 21st, 1980, toothed wheel 65 can additionally be coupled to a drive cam 133 which is rotatably mounted, via a shaft 133', on a pivot lever 135 which is pivotable about a fixed axis 121. Drive cam 133 is biassed, or urged, in a counterclockwise direction by a spring 139 connected between cam 133 and lever 135.

A latch 137 is pivotable about a fixed axis 137' and carries an actuating tongue 138 arranged to engage an abutment 134 carried by cam 133. Latch 137 is connected, via a pull rod 111, with a pivot lever 115 which is pivotable about a fixed axis 115' and carries an armature 117 that cooperates with an electromagnet 119. Electromagnet 119 acts on lever 115 against the force of a resetting spring 113. If electromagnet 119 is excited, cam 133 is caused to rotate and lever 135 is pivoted in the same manner as described above with reference to cam 55 and lever 53.

Lever 135 carries a pusher 123 which acts, through a suitable known mechanism, to lift ribbon guide forks 17 and 19 of FIG. 1.

In order to optimally utilize different types of color and carbon ribbons, such different ribbons must be subjected to transporting steps of different lengths in the longitudinal direction as the ribbon passes through the printing station. This is most easily accomplished by the present invention in that the position of a guide pin 85 engaging the drive lever 53 can be varied so as to change the angular extent of each step of rotation of the pivot lever 47.

For this purpose, the guide pin 85 is displaceable in a radial slot 87 in the drive lever 53 and can be engaged in various detent points 89 and 91 provided at the ends of a slot 97 in the pivot lever 47. The guide pin 85 is fixed to a tilt lever 95 which is both displaceably and pivotally mounted on the drive lever 53. The tilt lever 95, on the one hand, can be displaced by movement of the guide pin 85 in slot 87 and, on the other hand, is mounted by means of a pivot pin 98 to be displaceable in a second slot 99. The second slot 99 is arranged to be perpendicular to the first slot 87. The slot 99 is arranged in the drive lever 53.

The tilt lever 95 is arrested in each of its two end positions, each corresponding to engagement of pin 85 in a respective one of detent points 89 and 91, by means of a spring 101 tensioned between the tilt lever 95 and the drive lever 53. As shown, spring 101 is held between pin 98 and a pin 53' carried by lever 53. Pivoting of the tilt lever 95 out of the detent position 91 into the detent position 89 is effected by the action of an intermediate lever 102, shown in FIG. 1, which is arranged to be pivotal about an axis 103 fixed in the receiving device 3. The intermediate lever 102 has a first arm 105 provided with a recess 104 which encloses the guide pin 85, and a second arm 107 carrying an abutment pin 106 which is in cooperative connection with a recess 108 at the free end of pivot lever arm 24 carrying the pressure roller 25.

In order to remove the ribbon cartridge 1 from the receiving device 3, the pivot lever 12 is pivoted, by acting on handle 10, counterclockwise about its axis 14, toward the position of handle 10 which is shown in broken lines in FIG. 1. When the abutment pin 16 abuts against the upper surface of control cam 20, the pivot lever 26 is caused to be pivoted clockwise about the axis 28 until the abutment pin 16 has reached the detent recess 18. Levers 12 and 26 are then held in this position by recess 18 against the return force applied by reset spring 8 which is articulated at the pivot lever 26 to urge it in a counterclockwise direction. Since the pressure roller 25, when the pivot lever 26 is in the detent position, has been pivoted out of the cartridge 1, the cartridge 1 can be removed from the receiving device 3. Insertion of a new cartridge 1 can now be effected in precisely the reverse manner.

If a cartridge 1 holding a single-use carbon ribbon 11, and shown in FIGS. 1–3, has been inserted, the pivot levers 12 and 26 are released by manual action on handle 10. The pivot lever 26 is here pivoted counterclockwise by the return spring 8 to the extent that the pressure roller 25 comes to rest against the feed roller 23. This causes the pivot lever 26 to move so that the free end of its arm 24 shifts from position I to position II as shown in FIG. 1 without yet acting on the abutment pin 106 of the intermediate layer 102 so that the tilt lever 95 remains in the detent position 91 shown in FIG. 7. In this position, the pivot lever 47 is pivoted by each rotation of cam 55 to such an extent that the toothed wheel 41 is rotated by means of drive pawl 43 through the large step length required for a single-use carbon ribbon 11. In this case, each surface portion of the carbon ribbon 1 can be used only once for printing.

Figure 4:
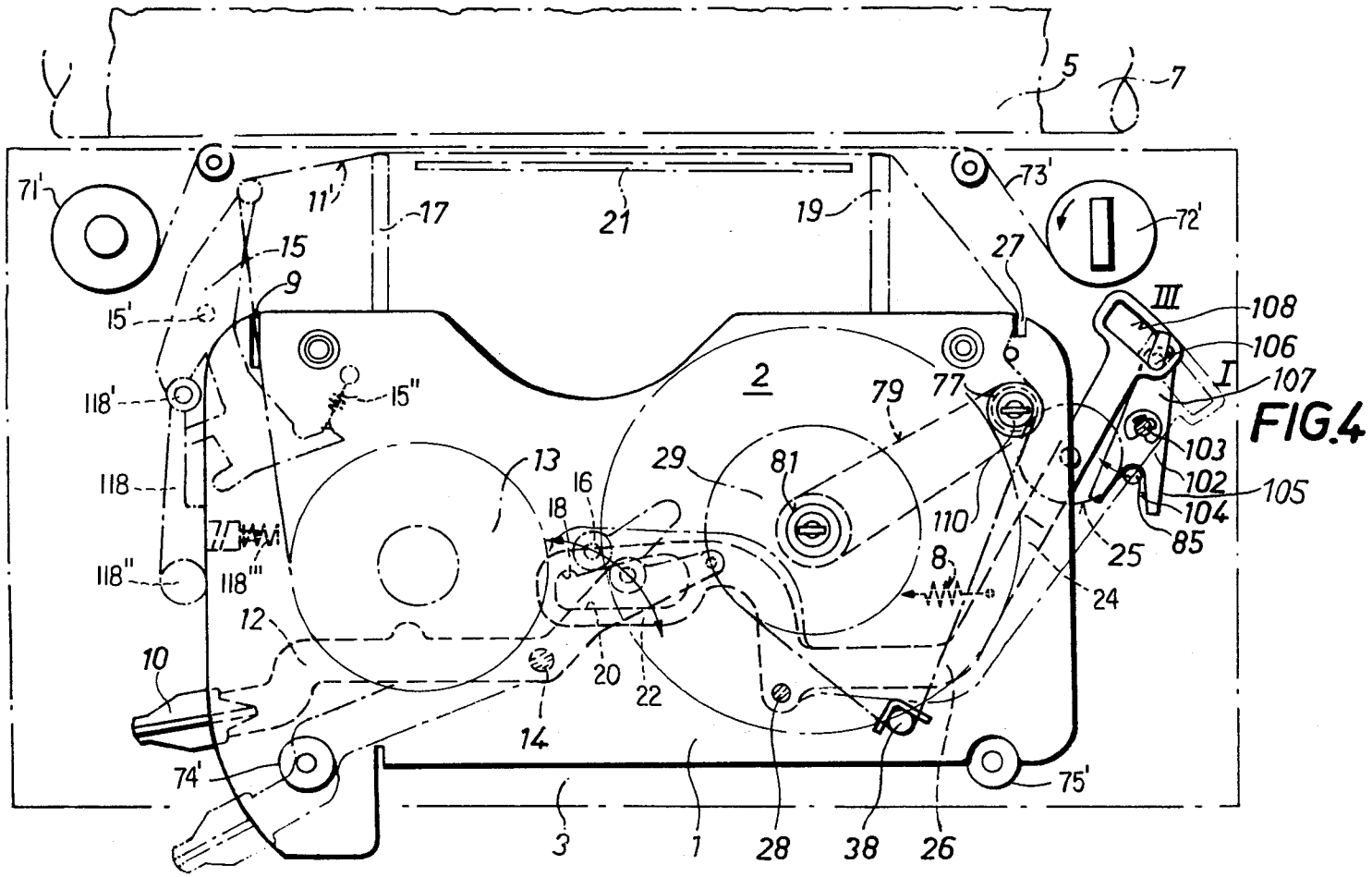
FIG. 4 is a view similar to that of FIG. 1 of a preferred embodiment of a ribbon cartridge according to the invention for a multi-use carbon ribbon.
Figure 5:
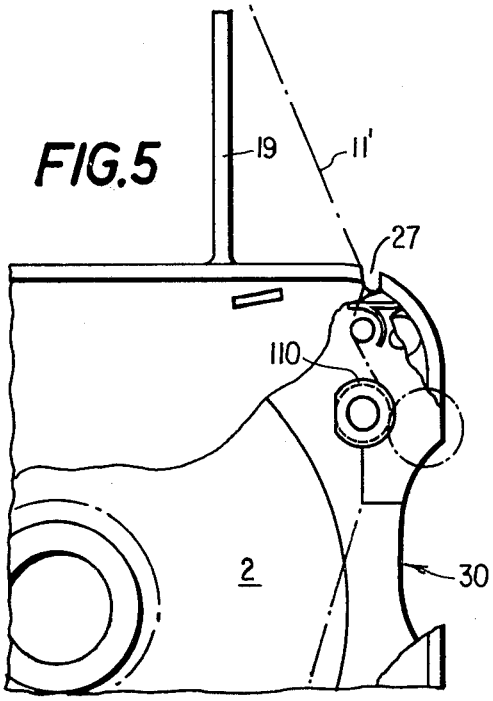
FIGS. 5 and 6 are views similar to those of FIGS. 2 and 3 relating to the embodiment of FIG. 4.
Figure 6:
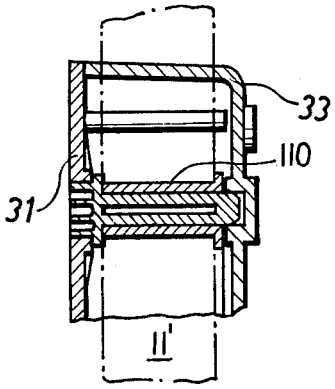

When a multi-use carbon ribbon 11′ installed in the cartridge 1 shown in FIGS. 4–6 is used, the cartridge 1 is provided with a feed roller 10, which replaces and has a smaller diameter than, the feed roller 23 for single-use carbon ribbons 11. In this case, the free end of arm 24 of pivot lever 26 can be pivoted from position I to position III, shown in FIG. 4, causing the intermediate lever 102 to be pivoted counterclockwise about the axis 103 in that the recess 108 abuts against, and displaces, the abutment pin 106. This causes the tilt lever 95 of FIG. 7 to be pivoted out of the detent position 91 and into the detent position 89. Since the guide pin 85 now is effective upon a longer lever arm of the pivot lever 47, the latter is pivoted through a correspondingly shorter angular path. The drive gear 41 and the drive roller 110 fixed thereto are driven over a correspondingly shorter angular path so that the successively struck types are brought into contact with the ribbon 11′ in an overlapping manner. Due to the small advancing step length, economical utilization of the multi-use carbon ribbon 11′ is assured.

Changing of the step width of the pawl drive takes place automatically together with the release of the pivot lever 26 and the pressure roller 25. In the embodiment of FIGS. 1–3, the smooth surface of the feed roller 23 and of the pressure roller 25 help to prevent soiling of the machine. The ribbon 11 is pivoted in the ribbon entrance slit 27 about the guide rib 42, shown in FIG. 2 disposed transversely behind the entrance slit 27 in the cartridge 1, thus preventing excessive soiling of the cartridge 1 and of the machine. In the embodiment of FIGS. 4–6, roller 110 also has a smooth surface which helps to prevent soiling.

It will be understood that the above description of the present invention is susceptible to various modifications, changes and adaptations, and the same are intended to be comprehended within the meaning and range of equivalents of the appended claims.

What is claimed is:

1. In a feed mechanism for advancing an ink ribbon supported in a cartridge which is inserted into a typing machine in feeding steps whose length is determined in dependence upon the type of the ribbon, the cartridge including a supply reel and a takeup reel between which the ribbon is advanced, guides being provided for guiding the ribbon through a printing station of the machine, the improvement wherein said mechanism comprises: a feed roller rotatably mounted in said cartridge for engaging the ribbon to advance the ribbon in feeding steps, said feed roller being selected from a plurality of feed rollers having respectively different diameters on the basis of the type of the ribbon; a driving device mounted in said machine and including a pressure roller movable into a position against said feed roller when said cartridge is inserted in said machine; and means for rotating said feed roller in angular steps for advancing the ribbon in corresponding feeding steps, said rotating means being settable for causing each angular step of rotation of said feed roller to have a selected one of at least two different magnitudes, each magnitude corresponding to a respectively different ribbon feeding step length, and said rotating means being coupled to said pressure roller in a manner to be set to produce angular rotation steps of a selected magnitude in dependence on the position of said pressure roller when said pressure roller is in its position against said feed roller, whereby the magnitude of each ribbon feeding step is automatically determined as a function of the diameter of said selected feed roller.

2. An arrangement as defined in claim 1 wherein said cartridge comprises a bottom plate which faces downwardly toward the bottom of said machine when said cartridge is inserted into said machine, said feed roller is provided with an axially extending slot accessible via said bottom plate, and said means for rotating said feed roller comprise: a driving element in the form of a blade positioned to drivingly engage in said slot when said cartridge is inserted in said machine; a rotatably mounted ratchet wheel connected for rotating said driving element; a driving pawl operatively associated with said ratchet wheel; a first lever mounted for pivotal movement about the axis of rotation of said ratchet wheel, said driving pawl being connected to one end of said first lever for movement therewith and said first lever being provided with a slot extending in a radial direction relative to its pivot axis and having a plurality of detent recesses; a drive member arranged to undergo a predetermined movement for producing each ribbon feeding step; a second lever pivotally mounted at one end on said drive member; a guide pin carried by the other end of said second lever and disposed in said first lever slot for selective engagement in one of said detent recesses for coupling said first lever to said drive member; and setting means including a third lever for controlling the movement of said second lever in a manner to place said guide pin in a selected detent recess under control of the position of said pressure roller when said pressure roller is against said feed roller.

3. An arrangement as defined in claim 2 further comprising a biassing spring operatively associated with said one end of said second lever for maintaining said guide pin in a selected detent recess, and wherein said setting means further comprise a fourth lever operatively associated with said third lever and said guide pin for moving said guide pin to a selected detent recess in response to movement of said third lever.

4. An arrangement as defined in claim 3 wherein said fourth lever is pivotally mounted on said machine and includes first and second arms extending from its pivot axis, said first arm being provided with a recess in which said guide pin engages and said second arm being coupled to said third lever to establish the operative association between said third and fourth levers.

5. An arrangement as defined in claim 4 wherein said third lever is provided with a recess and said fourth lever is provided with an abutment pin engaging in said recess of said third lever to thereby establish said operative association between said third and fourth levers.

6. An arrangement as defined in claim 2, 3, 4 or 5 wherein: said pressure roller is rotatably mounted on said third lever; said third lever is pivotally mounted on said machine and includes first and second arms extending from its pivot axis, said first arm of said third lever being connected to control said movement of said guide pin and said second arm of said third lever being provided with a control cam presenting a detent recess; and said mechanism further comprises a latching lever pivotally mounted on said machine and carrying a detent bolt engaging said control cam and engageable in said detent recess of said control cam for moving said pressure roller clear of said cartridge to permit removal of said cartridge from said machine.

7. An arrangement as defined in claim 6 wherein both said feed roller and said pressure roller have smooth surfaces via which said rollers engage the ribbon.

8. A cartridge arranged to be inserted into a typing machine, said cartridge comprising: an ink ribbon of a selected type which is to be advanced in feeding steps whose length is determined in dependence upon the type of the ribbon; a supply reel and a takeup reel between which said ribbon extends; and a feed roller rotatably mounted in said cartridge for engaging said ribbon to advance said ribbon in feeding steps, said feed roller being selected from a plurality of feed rollers having respectively different diameters with each diameter corresponding to a respectively different type of ribbon; said cartridge being provided with an opening for passage of a sensing member mounted on the machine into engagement with said feed roller for sensing the diameter of said feed roller and setting the magnitude of each angular step of rotation of said feed roller as a function of its diameter, whereby the magnitude of each ribbon feeding step is automatically determined by the magnitude of each angular step of rotation and the diameter of said selected feed roller.

9. An arrangement as defined in claim 8 wherein said cartridge is provided with an entrance opening through which the ribbon passes and comprises a first deflection guide disposed between said entrance opening and said feed roller for guiding the ribbon to said feed roller, and a second deflection guide disposed to the side of said takeup reel which is opposite said entrance opening in the vicinity of the periphery of said takeup reel for guiding the ribbon from said feed roller to said takeup reel.

10. An arrangement as defined in claim 9 wherein said cartridge comprises a cover member provided with guide ribs in the regions of said entrance opening and said deflection guides, and said feed roller is provided with a flange at the axial end thereof adjacent said cover member.

11. An arrangement as defined in claim 10 wherein said cartridge further comprises a bottom plate spaced from said cover member and provided with guide faces which are inclined away from said plate toward said feed roller and said first deflection guide.

12. An arrangement as defined in claim 8, 9 10 or 11 wherein said feed roller is arranged to contact the face of the ribbon which does not effect printing and at least the surface of said feed roller consists of a polyelastomer having a Shore hardness A 75–95.

13. A cartridge arranged to be inserted into a typing machine, said cartridge comprising: an ink ribbon of a selected type which is to be advanced in feeding steps whose length is determined in dependence upon the type of the ribbon; and a feed roller rotatably mounted in said cartridge for engaging said ribbon to advance said ribbon in feeding steps, said feed roller being selected from a plurality of feed rollers having respectively different diameters with each diameter corresponding to a respectively different type of ribbon; said cartridge being provided with an opening for passage of a sensing member mounted on the machine into engagement with said feed roller for sensing the diameter of said feed roller and setting the magnitude of each angular step of rotation of said feed roller as a function of its diameter, whereby the magnitude of each ribbon feeding step is automatically determined by the magnitude of each angular step of rotation and the diameter of said selected feed roller.

14. A cartridge arranged to be inserted into a typing machine, said cartridge comprising: an ink ribbon of a selected type which is to be advanced in feeding steps whose length is determined in dependence upon the type of the ribbon; a feed roller rotatably mounted in said cartridge for engaging said ribbon to advance said ribbon in feeding steps, said feed roller being selected from a plurality of feed rollers having respectively different diameters with each diameter corresponding to a respectively different type of ribbon; and abutment means to be engaged by a sensing member mounted on the machine for sensing the abutment means and setting the magnitude of each angular step of rotation of said feed roller as a function of the position of the sensing member when engaging said abutment means, whereby the magnitude of each ribbon feeding step is automatically determined by the magnitude of each angular step of rotation and the position of said abutment means.

* * * * *